US006991307B2

(12) United States Patent
Hoenig

(10) Patent No.: US 6,991,307 B2
(45) Date of Patent: Jan. 31, 2006

(54) DRAWER ORGANIZER

(76) Inventor: Peter Hoenig, 6420 Oakridge, Lasalle, Ontario (CA) N9J 3P9

( * ) Notice: Subject to any disclaimer, the term of this patent is extended or adjusted under 35 U.S.C. 154(b) by 63 days.

(21) Appl. No.: 10/347,049

(22) Filed: Jan. 17, 2003

(65) Prior Publication Data

US 2003/0137227 A1 Jul. 24, 2003

Related U.S. Application Data

(60) Provisional application No. 60/351,541, filed on Jan. 24, 2002.

(51) Int. Cl.
*A47B 88/00* (2006.01)

(52) U.S. Cl. ..... 312/348.3; 312/348.2; 220/559; D6/491; 211/184

(58) Field of Classification Search ..... 312/348.3, 312/348.2; 220/559, 551, 529; D6/491, D6/510, 511; 211/184
See application file for complete search history.

(56) References Cited

U.S. PATENT DOCUMENTS

| | | | | |
|---|---|---|---|---|
| 367,981 A | | 8/1887 | Hodge | |
| 1,849,024 A | * | 3/1932 | McKee | 160/216 |
| 1,919,568 A | | 7/1933 | McCosh | |
| 2,148,681 A | | 2/1939 | Cameron | 220/22 |
| 2,743,774 A | * | 5/1956 | Pinto | 160/351 |
| 3,710,974 A | | 1/1973 | Hage | 220/22.4 |
| 4,081,100 A | | 3/1978 | Presby | 220/22.4 |
| 4,305,629 A | | 12/1981 | Friis | 312/204 |
| 4,957,213 A | | 9/1990 | White et al. | 220/559 |
| 5,489,148 A | | 2/1996 | Grass | 312/348.2 |
| 6,357,844 B1 | * | 3/2002 | Muterthies et al. | 312/348.3 |
| D473,080 S | * | 4/2003 | Kellogg | D6/491 |

* cited by examiner

*Primary Examiner*—Laurie K. Cranmer
(74) *Attorney, Agent, or Firm*—Bliss McGlynn, P.C.

(57) ABSTRACT

A drawer organizer for partitioning the interior space of a drawer having at least two opposed walls includes a male member, a female member, and a biasing member. The male member has a base including at least one substantially flat end wall and a body extending from the base. The female member has a base including at least one substantially flat end wall and a body extending from the base and defining a housing having an open end. The biasing member is supported within the housing. The male member is received through the open end and operatively retained relative to the housing. The biasing member generates a biasing force acting between the male and female members to bias the male and female members in opposite directions relative to one another such that the end walls are braced against two opposed side walls of the drawer.

17 Claims, 5 Drawing Sheets

DRAWER ORGANIZER

CROSS REFERENCE TO RELATED APPLICATIONS

This application claims the benefit of U.S. provisional application No. 60/351,541, filed Jan. 24, 2002.

BACKGROUND OF THE INVENTION

1. Field of the Invention

The present invention relates generally to a drawer organizer and, more particularly, a spring-biased drawer organizer that automatically adapts to the dimensions of a drawer.

2. Description of the Related Art

Items in a drawer are often not kept in an orderly fashion. In these instances, time must be spent searching through the drawer to find the particular item sought. This can be irritating and inefficient. Drawer organizers were developed in response to this problem. Drawer organizers serve to organize, sort, and/or segregate items within a drawer. While they have worked for their intended purposes, the drawer organizers of the related art generally suffer from the disadvantage that they occupy too much space in the drawer and thus limit the drawer capacity. In addition, they can be time-consuming and difficult to install. More specifically, installation of known drawer organizers requires tools and other devices and involves cutting and other permanent alteration of the drawer organizer as well as nailing, gluing, clamping, and the like to secure the drawer organizer within the drawer. In addition, the drawer organizers of the related art imprecisely fit the dimensions within a drawer, because they are usually designed for use with a particular type of a drawer.

Thus, there is a need in the related art for a drawer organizer that is adjustable, efficiently sized and simple to quickly install within a drawer. In addition, there is a need in the related art for a drawer organizer that precisely fits the dimensions within a drawer, and designed for use within any type of a drawer.

SUMMARY OF THE INVENTION

The present invention overcomes the disadvantages in the related art in a drawer organizer for partitioning the interior space of a drawer having at least two opposed walls. The drawer organizer of the present invention includes a male member, a female member, and a biasing member. The male member has a base including at least one substantially flat end wall and a body extending from the base. The female member has a base including at least one substantially flat end wall and a body extending from the base and defining a housing having an open end. The biasing member is supported within the housing. The male member is received through the open end and operatively retained relative to the housing. The biasing member generates a biasing force acting between the male and female members to bias the male and female members in opposite directions relative to one another such that the end walls are braced against two opposed side walls of the drawer.

One object of the present invention is to provide an organizer for use in a drawer that is readily adjustable to size and can be quickly positioned at any point along the length, width, and depth of the drawer without the need for permanent fasteners so as to organize, sort, and/or segregate articles within the drawer.

Another object of the present invention is to provide an organizer for use in a drawer that can be maintained, by reason of its construction, in an operative position within the drawer and easily positioned within or removed from the drawer without any physical changes to the construction of the organizer or the drawer.

An advantage of the drawer organizer of the present invention is that it occupies less space within a drawer than do the drawer organizers of the related art.

Another advantage of the drawer organizer of the present invention is that it is simpler and less time-consuming to install than are the drawer organizers of the related art.

Another advantage of the drawer organizer of the present invention is that it does not require the use of tools and other devices to install it as do the drawer organizers of the related art.

Another advantage of the drawer organizer of the present invention is that it does not involve cutting, nailing, gluing, clamping and/or any other permanent alteration of the drawer to install it as do the drawer organizers of the related art.

Another advantage of the drawer organizer of the present invention is that it is adjustable so that it more precisely fits the dimensions within a drawer than do the organizers of the related art.

Another advantage of the drawer organizer of the present invention is that it may be adapted for use with a wide variety of drawers.

Other objects, features, and advantages of the present invention will be readily appreciated as the same becomes better understood while reading the subsequent description taken in conjunction with the accompanying drawings.

DETAILED DESCRIPTION OF THE INVENTION

Figure 1:
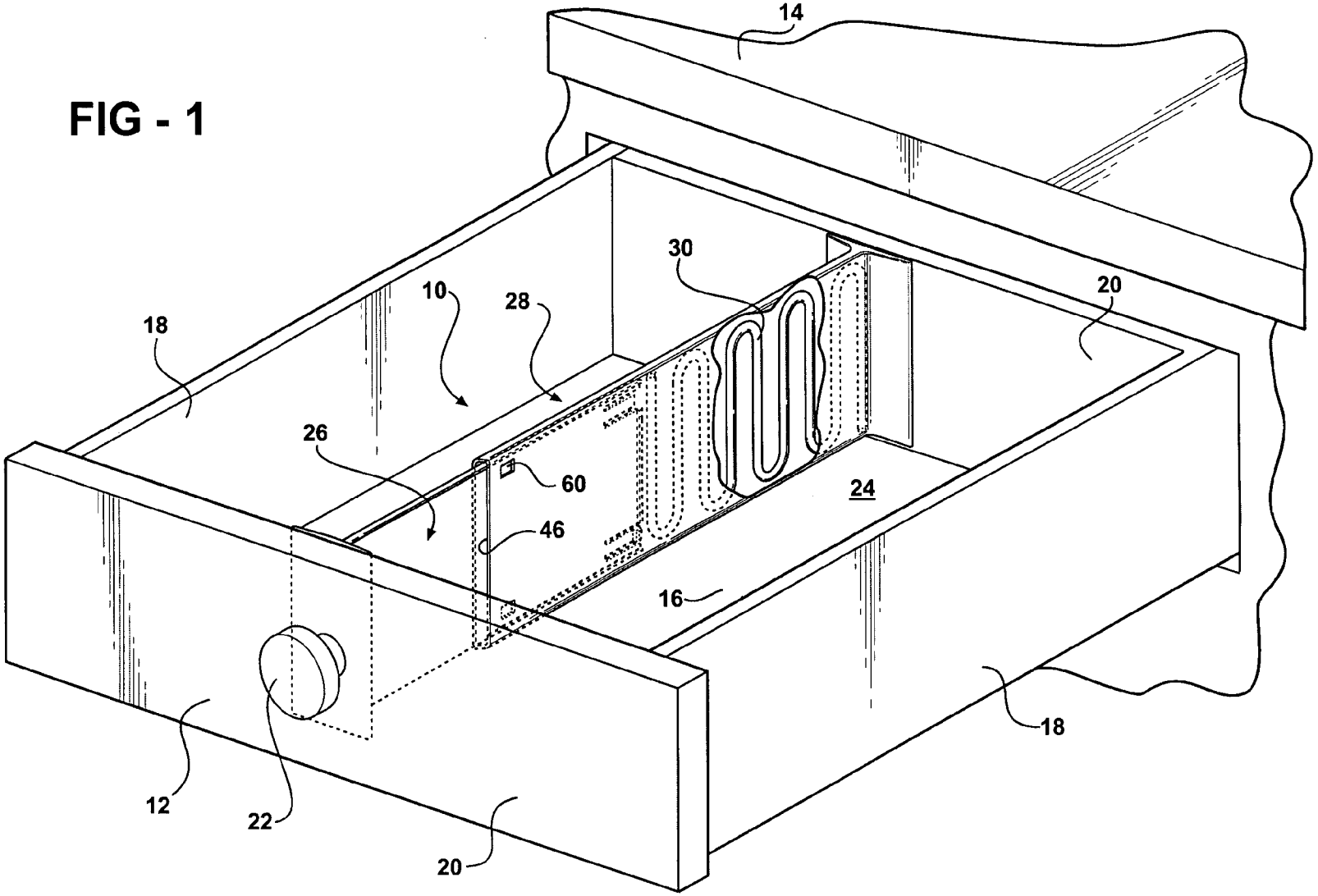
FIG. 1 is an environmental, partial phantom view of the drawer organizer of the present invention showing it in operation within a drawer.
Figure 2:
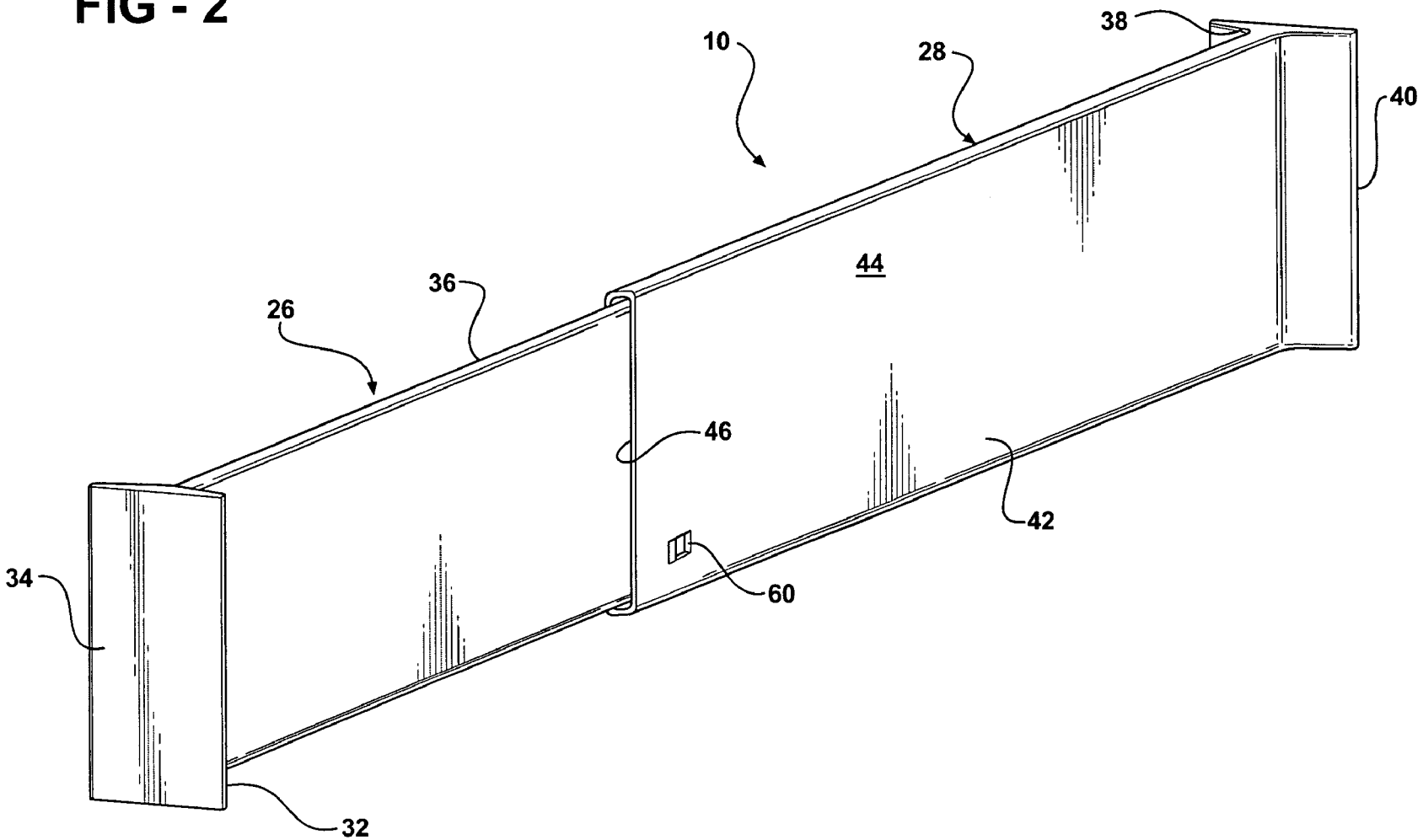
FIG. 2 is a perspective view of the drawer organizer of the present invention.
Figure 3:
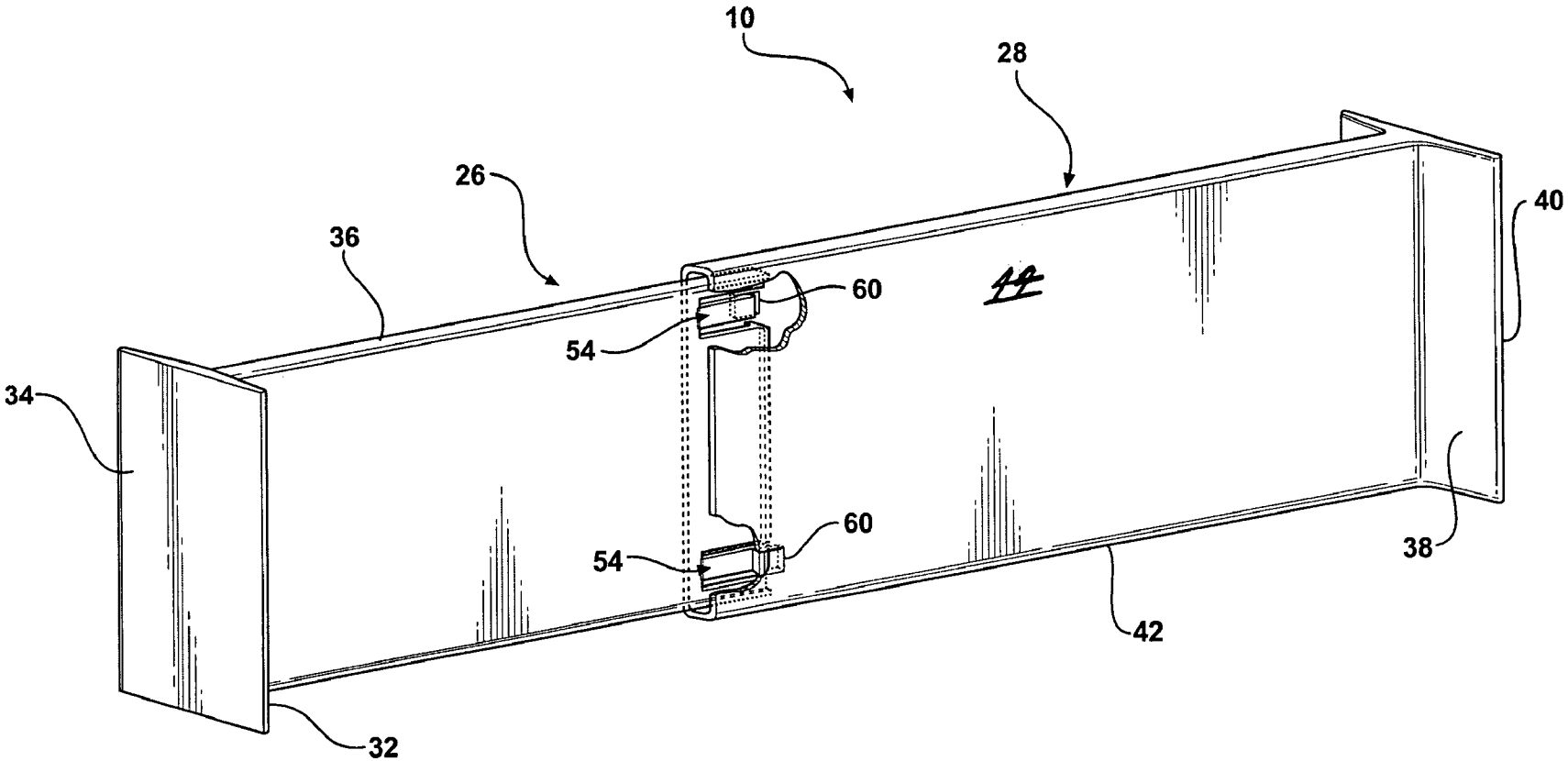
FIG. 3 is a perspective view of the drawer organizer of the present invention of FIG. 2 with a partially cut-away portion showing the tabs and detents of the retaining mechanism.
Figure 6:
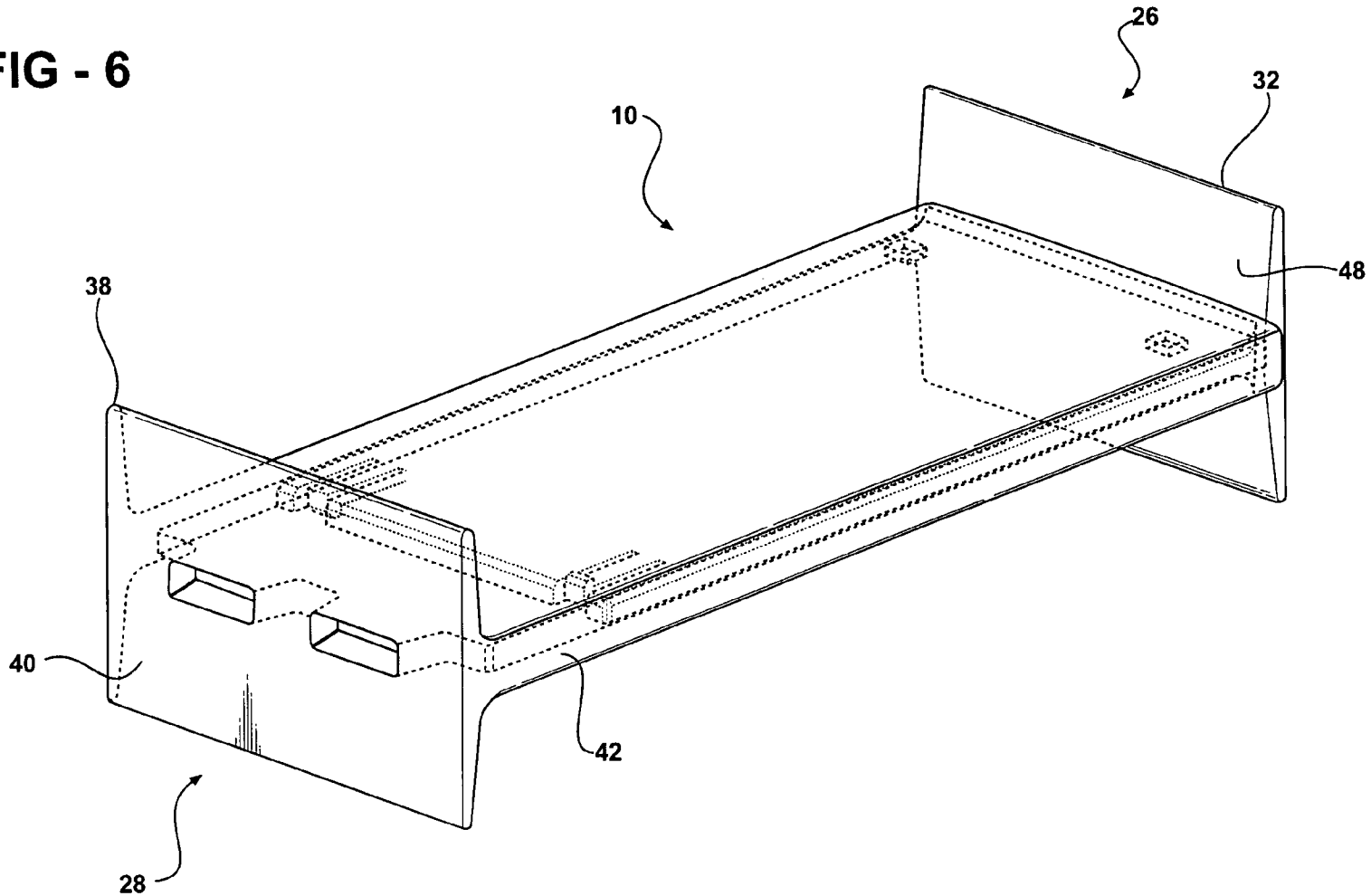
FIG. 6 is another perspective view of the drawer organizer of the present invention showing the tabs and detents of the retaining mechanism in phantom.

Referring now to the figures, where like numerals are used to designate like structure, a drawer organizer of the present invention is generally indicated at 10 and shown in operation within a drawer 12 in FIG. 1 and per se in FIGS. 2, 3, and 6.

In FIG. 1, the drawer 12 is shown substantially in an open disposition from the top end of a dresser 14. The drawer 12 is substantially of a rectangular shape and has a bottom surface 16, two opposed side walls 18, and two opposed end walls 20 extending between the ends of the side walls 18. A knob 22 for use with opening and closing the drawer 12 relative to the dresser 14 is shown connected to the end wall 20 opposite the dresser 14. The bottom surface 16, side walls 18, and end walls 20 define an interior space 24 of the drawer 12 that is adapted to receive articles. The drawer organizer 10 is shown in FIG. 1 partitioning the interior space 24 of the drawer 12 and is described below as being adapted for operative support and use within the drawer 12 for organizing, sorting, and/or segregating the articles. However, those having ordinary skill in the art will appreciate that the drawer organizer 10 may be so employed in filing cabinets, trays, boxes, and the like.

Figure 4:
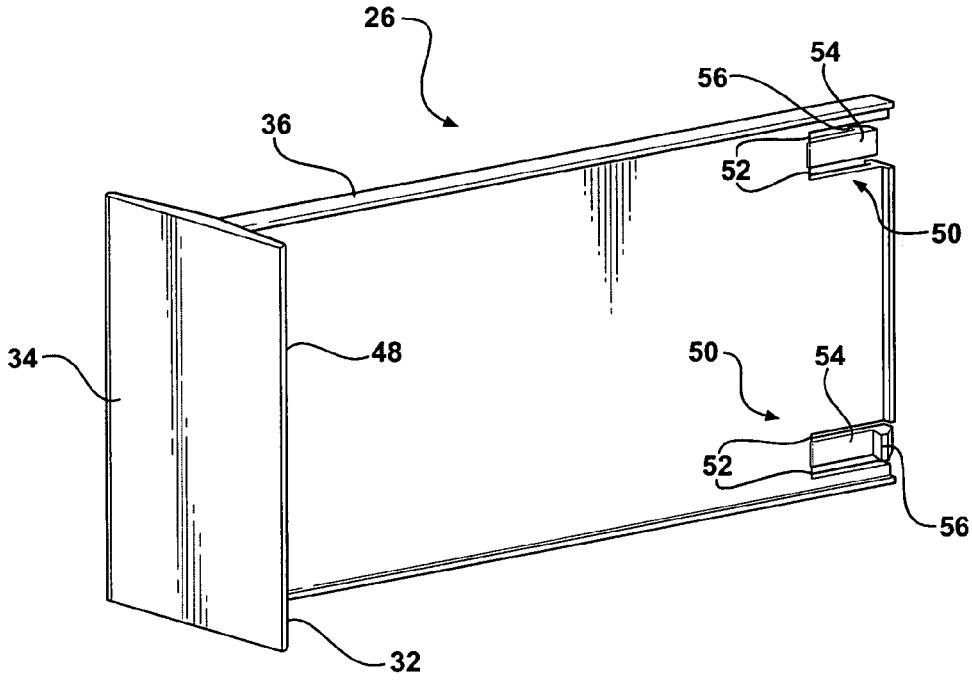
FIG. 4 is a perspective view of the male member of the drawer organizer of the present invention.
Figure 5:
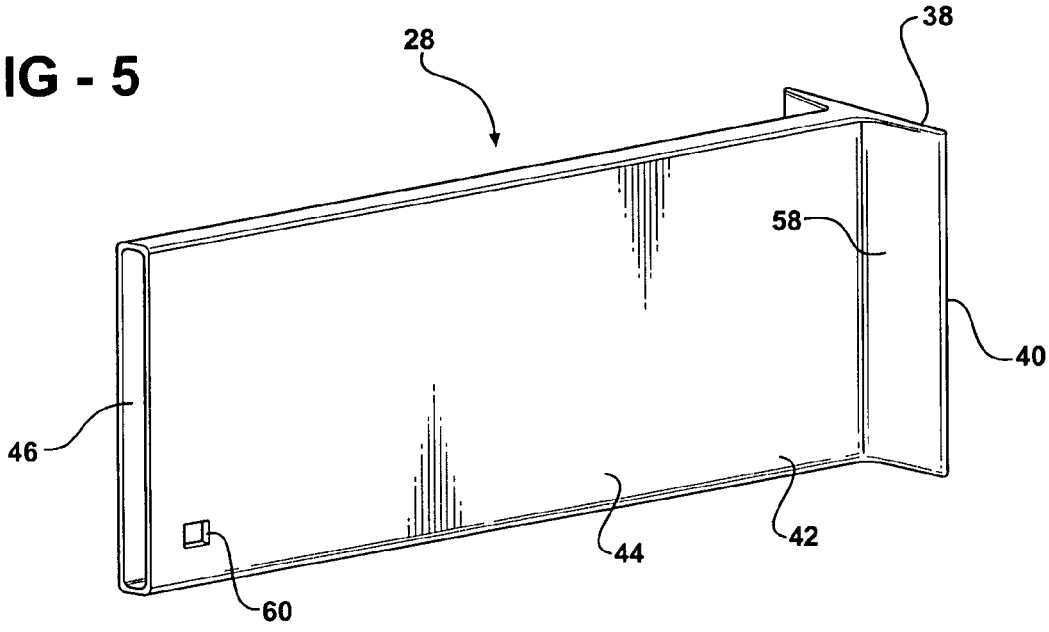
FIG. 5 is a perspective view of the female member of the drawer organizer of the present invention.

As shown in FIGS. 1, 2, 3, and 6, the drawer organizer 10 includes a male member, generally indicated at 26, a female member, generally indicated at 28, and a biasing member 30. In general and as best shown in FIGS. 4 and 5, the male member 26 has a base 32 including at least one substantially flat end wall 34 and a body 36 extending from the base 32. The female member 28 also has a base 38 including at least one substantially flat end wall 40 and a body 42 extending from the base 38. The body 42 defines a housing 44 having an open end 46. The biasing member 30 is supported within the housing 44.

As shown in FIGS. 1, 2, 3, and 6, the male member 26 is received through the open end 46 and operatively retained relative to the housing 44. The biasing member 30 generates a biasing force acting between the male and female members 26, 28, respectively, to bias them in opposite directions relative to one another such that the end walls 34, 40 are braced against two opposed side walls 18 of the drawer 12. Each of the male member 26, female member 28, and biasing member 30 will now be described in greater detail.

In a preferred embodiment of the drawer organizer 10 and as best shown in FIG. 4, the body 36 of the male member 26 is substantially rectangular and may be hollow or solid to any degree. The base 32 of the male member 26 also is substantially rectangular, has a height substantially equal to that of the body 36, and also may be hollow or solid to any degree. Also, the base 32 defines an inside face 48 that tapers away from the body 36 to the side edges of the base 32. Further, the base 32 is integrally formed with and extends substantially perpendicular to the body 36. Specifically, the inside face 48 is disposed substantially at a right angle to and co-extensively with the corresponding end of the body 36 at a substantially central area of the inside face 48.

In a preferred embodiment of the drawer organizer 10 and as best shown in FIG. 5, the body 42 of the female member 28 is substantially rectangular, has a thickness greater than that of the body 36 of the male member 26, and may be hollow or solid to any degree. The base 38 of the female member 28 also is substantially rectangular, has a height substantially equal to that of the body 42, and also may be hollow or solid to any degree. Also, the base 38 defines an inside face 58 that tapers away from the body 42 to the side edges of the base 38. Further, the base 38 is integrally formed with and extends substantially perpendicular to the body 42. Specifically, the inside face 58 is disposed substantially at a right angle to and co-extensively with the corresponding end of the body 42 at a substantially central area of the inside face 58. The open end 46 of the housing 44 is disposed opposite the base 38. The body 36 of the male member 26 is adapted to be operatively slidably received through the open end 46 within the housing 44.

In a preferred embodiment of the drawer organizer 10 and as best shown in FIG. 1, the biasing member 30 is a spring 30. The spring 30 is operatively retained within the housing 44 between the base 38 of the female member 28 and the body 36 of the male member 26. The spring 30 is adapted to operatively constantly urge the male member 26 longitudinally and away from the female member 28. However, those having ordinary skill in the art will appreciate that the biasing member 30 can have any suitable structure and take any suitable position within the drawer organizer 10 such that the biasing member 30 can operatively constantly urge the male member 26 longitudinally and away from the female member 28. Thus, those having ordinary skill in the art will appreciate that the biasing member 30 may take the form of a foam-like element or any other biasing force generating structure and that the present invention is not limited to the use of a spring.

The drawer organizer 10 of the present invention also includes a retaining mechanism, generally indicated at 50. The retaining mechanism 50 acts to retain the body 36 of the male member 26 within the housing 44 defined by the female member 28 and against the biasing force of the spring 30. The retaining mechanism 50 includes at least one open-ended slot 52 that may be formed in the end of the body 36 distal the base 32 and extending longitudinally into the body 36 toward the base 32. In addition, the retaining mechanism 50 may include at least one tab 54 extending in cantilevered fashion from the body 36 within the boundaries defined by the slot 52. The tab 54 includes a tooth 56 extending from the end of the tab 54 distal the body 36 and in a direction transverse to the tab 54. In particular, the tooth 56 extends substantially perpendicularly to the body 36 and parallel with the base 32.

The retaining mechanism 50 also includes at least one detent 60 formed on the body 42 of the female member 28 that corresponds with the tab 54. More specifically, the detent 60 is a substantially rectangular aperture formed in the housing 44. The tab 54 is received by the detent 60 to operatively retain the body 36 of the male member 26 within the housing 44 against the biasing force. In particular, the tooth 56 is cooperatively received within the detent 60.

In one embodiment, the male member 26 may include a pair of tabs 54 defined on the end of the body 36 distal the base 32 and in spaced relationship relative to one another. In this case, the tabs 54 are disposed substantially equidistantly from respective sides of the body 36. Similarly, the body 42 of the female member 28 may include a pair of detents 60 corresponding to the pair of tabs 54 and formed on the housing 44 in spaced relationship relative to one another and, in particular, at the end of the body 42 distal the base 38. The detents 60 correspond with the respective teeth 56 to operatively retain the male member 26 within the female member 28 upon assemblage of the drawer organizer 10, as best shown in FIG. 3.

Those having ordinary skill in the art will appreciate that each of the base 32, body 36, slots 52, and tabs 54 can be of any suitable structure. Also, the base 32, body 36, slots 52, and tabs 54 can have any suitable structural relationship with respect to each other. The body 36 can be attached to the base 32 by any suitable means, such as chemical or mechanical. Furthermore, the body 36 and base 32 can be made of any suitable material. In addition, the end wall 34 may be surfaced with an abrasive non-slipping material. Similarly, those having ordinary skill in the art will appreciate that each of the base 38, body 42, and detents 60 can be of any suitable structure such that the housing 44 can operatively slidably receive the body 36 of the male member 26. The base 38, body 42, and detents 60 can have any suitable structural relationship with respect to each other. The body 42 can be attached to the base 38 by any suitable means, such as chemical or mechanical. Furthermore, the body 42 and base 38 can be made of any suitable material. In addition, the end wall 40 may be surfaced with an abrasive non-slipping material.

Moreover, those having ordinary skill in the art will appreciate that the male member 26 can have any suitable number of tabs 54, each disposed in any suitable location on the male member 26, while the female member 28 can have any suitable corresponding number of detents 60 to operatively retain the male member 26 within the female member 28 upon assemblage of the drawer organizer 10. Those having ordinary skill in the art will also appreciate that the detents 60 can be disposed on the male member 26 and the tabs 54 can be disposed on the female member 28. For example, the body 36 of the male member 26 may include a pair of tabs 54 as described above or one tab 54 and one detent 60 disposed spaced relative to one another on the body 36. In this case, the body 42 of the female member 28 would likewise include a corresponding tab 54 and detent 60 that cooperate with the tab 54 and detent 60 on the body 36 of the male member. In fact, those having ordinary skill in the art will further appreciate that the drawer organizer 10 can have any suitably operative means to retain the male member 26 within the female member 28 upon assemblage of the drawer organizer 10.

The male member 26 and female member 28 are adapted to stabilize the drawer organizer 10 relative to opposite walls of the drawer 12 and extend along the entire width, length, as well as the depth of the drawer 12—from the bottom surface 16 of the drawer 12 to the top of the walls 18, 20.

In operation, the drawer organizer 10 is positioned within the drawer 12 such that the end walls 34, 40 of the bases 32, 38 are biased into contacting relationship with respective areas of opposite walls 18, 20 of the drawer 12. The spring 30 is adapted to permit displacement of the male member 26 relative to the female member 28 to automatically increase or decrease the length of the drawer organizer 10 to precisely fit the length or width of the drawer 12. Thus, no manual adjustment of the length of the drawer organizer 10 is necessary. The length of the drawer organizer 10 automatically expands and contracts to engage the opposite walls 18, 20 of the drawer 12. As already described, the end walls 34, 40 may have a non-slip abrasive material to further ensure against slipping of the drawer organizer 10 along the walls 18, 20 of the drawer 12. In addition, non-slip material may be placed on the longitudinal-edge facings of each of the bases 32, 38 and/or bodies 36, 42 to further ensure against slipping of the drawer organizer 10 along the bottom surface 16 of the drawer 12.

The tension of the spring 30 and the resulting force of the end walls 34, 40 against respective areas of opposite walls 18, 20 of the drawer 12 are such as to yieldably maintain the drawer organizer 10 in a desired position within the drawer 12. Specifically, the length of the drawer organizer 10 is adapted to range from substantially the length of the female member 28 to substantially the length of the combination of the female member 28 and the male member 26. Also, the drawer organizer 10 can be disposed within the drawer 12 at any angle between completely vertical to completely horizontal. Furthermore, the construction of the drawer 12 is not effected. The drawer organizer 10 is removable and may be positioned at any desired pair of points of respective opposite walls within the drawer 12. Moreover, multiple drawer organizers 10 may be used at one time in the drawer 12, further allowing for more division of items within the drawer 12.

The male member 26 and the female member 28 are preferably made of injection-molded plastic. However, those having ordinary skill in the art will appreciate that the drawer organizer 10 may be constructed of wood, metal, or other like material or any combination thereof. The drawer organizer 10 may be employed in large filing cabinets, trays, boxes, and the like by proportionally increasing or decreasing the size of the drawer organizer 10.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims the invention may be practiced other than as specifically described.

What is claimed is:

1. A drawer organizer for partitioning the interior space of a drawer having at least two opposed walls, said drawer organizer comprising:

a male member having a base including at least one substantially flat end wall and a body extending from said base;

a female member having a base including at least one substantially flat end wall and a body extending from said base, said body of said female member defining a housing having an open end; and a biasing member supported within said housing;

said male member being received through said open end and operatively retained relative to said housing and said biasing member generating a biasing force acting between said male and female members to bias said male and female members in opposite directions relative to one another such that said end walls are braced against two opposed side walls of the drawer, said bodies including a retaining mechanism that cooperates to retain said body of said male member within said housing and against the biasing force and includes at least one open-ended slot formed in the end of said body of said male member distal said base and extending longitudinally into said body toward said base and at least one tab extending in cantilevered fashion from said body of said male member into said slot.

2. A drawer organizer as set forth in claim 1, wherein said at least one tab includes a tooth extending from the end of said at least one tab distal said body and in a direction transverse to said at least one tab.

3. A drawer organizer as set forth in claim 2, wherein said retaining mechanism has at least one detent formed on said body of said female member that corresponds with said at least one tab, said at least one tab being received by said at least one detent to operatively retain said body of said male member within said housing against the biasing force.

4. A drawer organizer as set forth in claim 3, wherein said tooth is cooperatively received within said at least one detent.

5. A drawer organizer as set forth in claim 3, wherein said at least one detent is a substantially rectangular aperture formed in said housing.

6. A drawer organizer as set forth in claim 3, wherein said body of said male member includes a pair of tabs defined on the end of said body of said male member distal said base and in spaced relationship relative to one another.

7. A drawer organizer as set forth in claim 6, wherein said body of said female member includes a pair of detents corresponding to said pair of tabs and formed on said housing in spaced relationship relative to one another.

8. A drawer organizer as set forth in claim 1, wherein said biasing member is a spring.

9. A drawer organizer as set forth in claim 1, wherein said base of said male member is integrally formed with and extends substantially perpendicular to said body of said male member.

10. A drawer organizer as set forth in claim 1, wherein said base of said female member is integrally formed with and extends substantially perpendicular to said body of said female member.

11. A drawer organizer for partitioning the interior space of a drawer having at least two opposed walls, said drawer organizer comprising:

a male member having a base including at least one substantially flat end wall and a body integrally formed with and extending substantially perpendicular to said base;

a female member having a base including at least one substantially flat end wall and a body integrally formed with and extending substantially perpendicular to said base of said female member and defining a housing having an open end; and a spring supported within said housing;

said male member being received through said open end and operatively retained relative to said housing and said spring generating a biasing force acting between said male and female members to bias said male and female members in opposite directions relative to one another such that said end walls are braced against two opposed side walls of the drawer, said bodies including a retaining mechanism that cooperates to retain said body of said male member within said housing and against the biasing force and includes at least one open-ended slot formed in the end of said body of said male member distal said base and extending longitudinally into said body toward said base and at least one tab extending in cantilevered fashion from said body of said male member into said slot.

12. A drawer organizer as set forth in claim 11, wherein said at least one tab includes a tooth extending from the end of said at least one tab distal said body and in a direction transverse to said at least one tab.

13. A drawer organizer as set forth in claim 12, wherein said retaining mechanism has at least one detent formed on said body of said female member that corresponds with said at least one tab, said at least one tab being received by said at least one detent to operatively retain said body of said male member within said housing against the biasing force.

14. A drawer organizer as set forth in claim 13, wherein said tooth is cooperatively received within said at least one detent.

15. A drawer organizer as set forth in claim 13, wherein said at least one detent is a substantially rectangular aperture formed in said housing.

16. A drawer organizer as set forth in claim 13, wherein said body of said male member includes a pair of tabs defined on the end of said body of said male member distal said base and in spaced relationship relative to one another.

17. A drawer organizer as set forth in claim 16, wherein said body of said female member includes a pair of detents corresponding to said pair of tabs and formed on said housing in spaced relationship relative to one another.

* * * * *